US012060656B2

(12) United States Patent
Ranjan et al.

(10) Patent No.: US 12,060,656 B2
(45) Date of Patent: Aug. 13, 2024

(54) CAPILLARY TYPE MULTI-JET NOZZLE FOR FABRICATING HIGH THROUGHPUT NANOFIBERS

(71) Applicant: E-SPIN NANOTECH PRIVATE LIMITED, Kanpur (IN)

(72) Inventors: Shivendu Ranjan, Chhapra (IN); Mahesh Kumar, Kanpur (IN); Ravindra Kumar, Kanpur (IN); Upama Tiwari, Kanpur (IN); Shivam Sachan, Kanpur (IN); Sandip Patil, Kanpur (IN)

( * ) Notice: Subject to any disclaimer, the term of this patent is extended or adjusted under 35 U.S.C. 154(b) by 607 days.

(21) Appl. No.: 17/317,658

(22) PCT Filed: Nov. 11, 2019

(86) PCT No.: PCT/IN2019/050834
§ 371 (c)(1),
(2) Date: May 11, 2021

(87) PCT Pub. No.: WO2020/095331
PCT Pub. Date: May 14, 2020

(65) Prior Publication Data

US 2022/0090298 A1 Mar. 24, 2022

(30) Foreign Application Priority Data

Nov. 11, 2018 (IN) ..... 201811038684

(51) Int. Cl.
*D01D 5/00* (2006.01)
*D01D 4/02* (2006.01)

(52) U.S. Cl.
CPC ..... *D01D 5/0069* (2013.01); *D01D 4/02* (2013.01)

(58) Field of Classification Search
CPC ..... B05B 15/63
See application file for complete search history.

(56) References Cited

U.S. PATENT DOCUMENTS 2,681,255 A * 6/1954 Downey ..... B05B 1/005 239/560
5,332,156 A * 7/1994 Wheeler ..... B08B 17/04 239/526
2012/0004370 A1* 1/2012 Scott ..... B05B 5/0255 585/16

(Continued)

*Primary Examiner* — Christopher T Schatz
(74) *Attorney, Agent, or Firm* — D'Ambrosio & Menon, PLLC; Usha Menon

(57) ABSTRACT

A capillary type multi-jet nozzle is provided for fabricating high throughput nanofibers by an electrospinning technique. The capillary type multi-jet nozzle includes a cap system with one or more pores and a crew system with a screw groove system. The cap system and the crew system are connected through a cap and crew system. The pores in the cap system are customized in count based on a requirement. The angle between the pores is reduced to make multiple non-interfering and non-hindering jets in less time. A TEFLON® gasket is used for proper tightening and sealing of the cap system and screw system. The cap system includes knurling at an outer surface for grip. The capillary type multi-jet nozzle is made of a conducting material to with stand a high voltage and is fabricated using micro-machining process.

4 Claims, 12 Drawing Sheets

(56) References Cited

U.S. PATENT DOCUMENTS

2012/0256018 A1* 10/2012 Lange ..... B05B 1/3402
239/587.1
2014/0353860 A1* 12/2014 Velasquez-Garcia .....
B05D 1/007
239/548

* cited by examiner

CAPILLARY TYPE MULTI-JET NOZZLE FOR FABRICATING HIGH THROUGHPUT NANOFIBERS

CROSS-REFERENCE TO RELATED APPLICATIONS

The present application is a National Phase application of the PCT application with the serial number PCT/IN2019/050834 filed on Nov. 11, 2019 with the title, "CAPILLARY TYPE MULTI-JET NOZZLE FOR FABRICATING HIGH THROUGHPUT NANOFIBERS". The present application claims the priority of the Indian Patent Application with serial number 201811038684 filed on Nov. 11, 2018 with the title, "CAPILLARY TYPE MULTI-JET NOZZLE FOR FABRICATING HIGH THROUGHPUT NANOFIBERS", and the contents of abovementioned Provisional Patent application and PCT applications are included entirely as reference herein.

BACKGROUND

Technical Field

The embodiments herein are generally related to a field of Multi-jet nozzles, electrospray nozzles, multi-nozzles, and electrospinning nozzles. The embodiments herein are particularly related to Multi-jet nozzles, electrospray nozzles, multi-nozzles, and electrospinning nozzles used in electrospinning, electrojetting or electrospraying devices. The embodiments herein are more particularly related to an apparatus and a method for fabricating high throughput nanofibers by electrostatic spinning of polymer liquid matrixes. The embodiments herein are especially related to Capillary Type Multi-Jet Nozzle for Fabricating High Throughput Nanofibers

Description of Related Art

Multi-jet nozzles, electrospray nozzles, multi-nozzles, and electrospinning nozzles used in electrospinning, electrojetting or electrospraying devices use various techniques as explained below. For example, an electrospray nozzle comprises a silicon substrate with a channel running between an entrance orifice and a nozzle output. The electrospray nozzle produces an electrospray perpendicular to the nozzle surface. A silicon substrate-based electrospray nozzle is used to controllably disperse a sample into a nanoelectrospray; however, the electrospray nozzle is not used for fiber production. The electrospinning nozzle forms part of an electrospinning, electrojetting- or electrospraying apparatus which further includes an electric field means arranged to form a fluid cone and a fluid jet. The electrospinning nozzle also collects the generated fibers or particles. A conventional electrospinning nozzle does not have multiple pores to act like a multi-nozzle for producing multiple jets of nanofibers or a nanospray under an electric field. The conventional electrospinning nozzle also does not have a syringe capped structure to act like a capillary type, user friendly, multi-jet nozzle for producing multiple jets of nanofibers or a nanospray under an electric field. Hence, there is a need for a nozzle comprising customizable pores and implementing a different technology to fabricate high-throughput nanofibers using an electrospinning technique.

OBJECTS OF THE EMBODIMENTS HEREIN

A primary object of the embodiments herein is to develop an apparatus and a method for fabricating high throughput nanofibers by electrostatic spinning of polymer liquid matrixes.

Another object of the embodiments herein is to develop an apparatus and a method for producing nanopowders by electrostatic spraying of polymer liquid matrixes.

Yet another object of the embodiments herein is to develop an apparatus and a method for producing nanofibers and nanopowders of a constant and uniform quality with a lowest possible demand for time, cleaning, maintenance, and adjustment.

Yet another object of the embodiments herein is to develop an apparatus comprising a capillary type multi-jet nozzle for use in electrospinning, electrojetting, and electrospraying for producing multiple fibers, droplets, or particles.

Yet another object of the embodiments herein is to develop an apparatus comprising a capillary type multi-jet nozzle for producing multiple jets by electrospinning, electrojetting and electrospraying techniques.

Yet another object of the embodiments herein is to develop a capillary type multi-jet nozzle comprising a cap system with one or more pores and a crew system with a screw groove system.

Yet another object of the embodiments herein is to provide a multi-jet electrospinning, electrojetting or electrospray apparatus with pores arranged to produce multiple jets pumped from a syringe.

Yet another object of the embodiments herein is to develop a multi-jet electrospinning, electrojetting or electrospray apparatus with a number of pores configured in the capillary type multi-jet nozzle and the number of pores is customized to be within 2 to 39 or more based on a requirement/need.

Yet another object of the embodiments herein is to develop grooves with small angles to produce multiple non-interfering and non-hindering jets in less time through electrospinning, electrospraying, and electrojetting processes.

Yet another object of the embodiments herein is to produce a uniform nanofiber coating with almost monodispersed pores between the nanofibers.

Yet another object of the embodiments herein is to enable/achieve a fast electrospinning process with respect to time with a high throughput and with no loss of fluid as wastage.

Yet another object of the embodiments herein is to provide a method for manufacturing fibers, particles, or droplets, from multiple jets produced by the capillary type multi-jet nozzle.

Yet another object of the embodiments herein is to maintain a high throughput nanofiber, nanodroplet and nanoparticle fabrication using electrospinning, electrojetting and electrospraying processes respectively.

These objects disclosed above will be realized and achieved at least by the elements, features, and combinations particularly pointed out in the claims. The objects disclosed above have outlined, rather broadly, the features of the embodiments disclosed herein in order that the detailed description that follows may be better understood. The objects disclosed above are not intended to determine the scope of the claimed subject matter and are not to be construed as limiting of the embodiments disclosed herein. Additional objects, features, and advantages of the embodiments disclosed herein are disclosed below. The objects disclosed above, which are believed to be characteristic of the embodiments disclosed herein, both as to its organization and method of operation, together with further objects, features, and advantages, will be better understood and illustrated by the technical features broadly embodied and described in the following description when considered in connection with the accompanying drawings.

SUMMARY

These and other aspects of the embodiments herein will be better appreciated and understood when considered in conjunction with the following description and the accompanying drawings. It should be understood, however, that the following descriptions, while indicating embodiments and numerous specific details thereof, are given by way of illustration and not of limitation. Many changes and modifications may be made within the scope of the embodiments herein without departing from the scope and spirit thereof, and the embodiments herein include all such modifications.

This summary is provided to introduce a selection of concepts in a simplified form that are further disclosed in the detailed description. This summary is not intended to determine the scope of the claimed subject matter.

The embodiments herein provide an apparatus and a method for fabricating high throughput nanofibers through an electrostatic spinning process of polymer liquid matrixes. The embodiments herein provide an apparatus comprising a capillary type multi-jet nozzle for fabricating high throughput nanofibers by an electrospinning technique. The capillary type multi-jet nozzle comprises a cap system with one or more pores and a crew system with a screw groove system. The cap system and the crew system are connected through a cap and crew system. According to an embodiment herein, the pores of the cap system are customizable in count. The number of pores are customized to be within 2 to 39 or more based on the need/requirement. The pores are arranged to produce multiple jets pumped from a syringe. According to an embodiment herein, an angle between the pores of the cap system is a small angle to achieve/produce multiple non-interfering and non-hindering jets in less time. According to an embodiment herein, the capillary type multi jet nozzle comprises a gasket made of a polytetrafluoroethylene (PTFE) polymer, such as TEFLON® for proper tightening and sealing of the cap system and the crew system. According to an embodiment herein, the cap system includes knurling at an outer surface of the cap system for grip.

According to an embodiment herein, the capillary type multi-jet nozzle is made of a conducting material to withstand a high voltage. According to an embodiment herein, an inner wall of the capillary type multi-jet nozzle has a smooth surface for an efficient flow of a fluid. According to an embodiment herein, the capillary type multi-jet nozzle is fabricated using micro-machining. According to an embodiment herein, the capillary type multi-jet nozzle is used in electrospinning, electrojetting, and electrospraying for producing multiple fibers, droplets, or particles. The capillary type multi-jet nozzle produces multiple jets by electrospinning, electrojetting and electrospraying techniques.

The embodiments herein also provide an apparatus and a method for producing nanopowders by electrostatic spraying of polymer liquid matrixes. Moreover, the embodiments herein also provide an apparatus and a method for producing nanofibers and nanopowders of a constant and uniform quality with a lowest possible demand for time, cleaning, maintenance, and adjustment. Furthermore, the embodiments herein also provide a method for manufacturing fibers, particles, or droplets, wherein the fibers, particles, or droplets are formed from multiple jets formed by the capillary type multi-jet nozzle. The embodiments herein disclose an apparatus and the method for a high throughput nanofiber, nanodroplet and nanoparticle fabrication using electrospinning, electrojetting and electrospraying processes.

The foregoing description of the specific embodiments will so fully reveal the general nature of the embodiments herein that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments herein have been described in terms of embodiments, those skilled in the art will recognize that the embodiments herein can be practiced with modification within the spirit and scope of the appended claims.

BRIEF DESCRIPTION OF THE DRAWINGS

The claims set forth the embodiments with particularity. The embodiments are illustrated by way of examples and not by way of limitation in the figures of the accompanying drawings in which like references indicate similar elements. Various embodiments, together with their advantages, may be best understood from the following detailed description taken in conjunction with the accompanying drawings.

DETAILED DESCRIPTION

Figure 1:
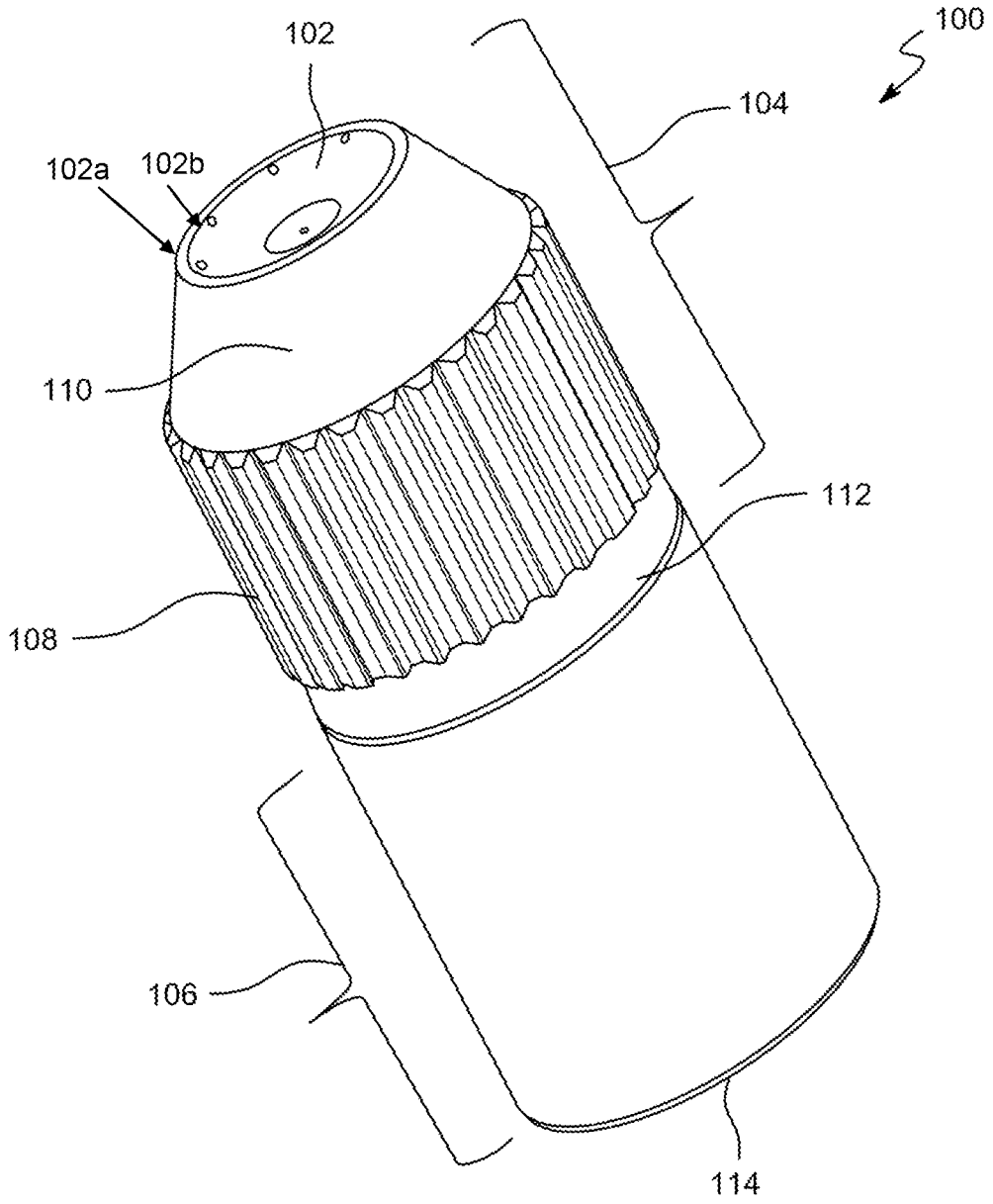
FIG. 1 illustrates a schematic diagram of a capillary type multi-jet nozzle for fabricating high throughput nanofibers, according to an embodiment herein.

Embodiments of techniques of a capillary type multi-jet nozzle for fabricating high throughput nanofibers are described herein. In the following description, numerous specific details are set forth to provide a thorough understanding of the embodiments. A person of ordinary skill in the relevant art will recognize, however, that the embodiments can be practiced without one or more of the specific details, or with other methods, components, materials, etc. In some instances, well-known structures, materials, or operations are not shown or described in detail.

References throughout this specification to "one embodiment", "this embodiment" and similar phrases, means that a feature, structure, or characteristic described in connection with the embodiment is included in one or more embodiments. Thus, the appearances of these phrases in various places throughout this specification are not necessarily all referring to the same embodiment. Furthermore, the features, structures, or characteristics may be combined in any suitable manner in one or more embodiments.

A capillary type multi-jet nozzle is created and a method is proposed for production of nano-fibers and nano-powders of a constant and uniform quality through electrostatic spinning and electrostatic spraying of polymer liquid matrixes respectively, at the large scale in a short-term period with the least demand for cleaning, maintenance and adjustment, thereby reducing manufacturing time, maintenance, cleaning, and non-uniformity.

The embodiments herein disclose/provide a unique capillary type multi-jet nozzle to be used in electrospinning, electrospraying, or electrojetting, devices for producing multiple fibers, droplets, or particles. In particular, the apparatus disclosed herein enables to produce multiple jets from the capillary type multi-jet nozzle for electrospinning, electrojetting, and electrospraying devices.

Electrospraying is a method used for spraying a liquid in an electrostatic field for producing an aerosol. In this method, the liquid is passed through a capillary tube with a high voltage at the tip. There is also provided a plate biased at a low voltage, such as ground, spaced apart from the capillary tube in a direction normal to the capillary tube. Higher capillary tip potential leads to the Taylor cone formation. A liquid jet is released through the tip of the Taylor cone. The jet rapidly forms into droplets as a result of a Coulomb repulsion in the jet.

According to an embodiment herein, a voltage source is connected between the tip of a capillary tube and a collector plate. Again, as a result of Columbic and overcoming surface tension forces, a Taylor cone is formed. The liquid is a polymer or other liquid has a preset (high) viscosity (due to high molecular weight), such that the liquid jet emitted from the Taylor cone does not break up. The jet is further elongated by electrostatic repulsion in the polymer or liquid until a thin fiber is produced. The fiber is finally deposited on the collector plate. Instabilities in the liquid jet and evaporation of a solvent causes the fiber to be curled and not straight. By a careful selection of a polymer and solvent system combined with a high electric field, fibers with nanometer scale diameters are formed.

Electrospinning is a fiber production method which uses an electric force to draw charged threads of polymer solutions or polymer melts to fiber diameters with a few hundred nanometers. Electrospinning has the combined characteristics of both electrospraying and a conventional solution of dry spinning of fibers. When a sufficiently high voltage is applied to a liquid droplet, the body of the liquid becomes charged, and an electrostatic repulsion counteracts the surface tension to stretch the droplet, at a critical point, and a stream of liquid erupts from the surface. This point is known as the Taylor cone. When the molecular cohesion of the liquid is sufficiently high, stream breakup does not occur (if it does, droplets are electrosprayed) and a charged liquid jet is formed. As the jet is dried during a flight of motion, the mode of current flow is changed as the charge is migrated to the surface of the fiber. The jet is then elongated by a whipping process caused by an electrostatic repulsion initiated at small bends in the fiber, until it is finally deposited on the grounded collector. The elongation and thinning of the fiber resulting from this bending instability lead to a formation of uniform fibers with nano-diameters. The electrospinning method is a versatile technique for nanofiber production. Materials such as polymers, composites, ceramic and metal nanowires are fabricated directly or through post-spinning processes. Fibers with diameters of 3-1000 nm are fabricated/obtained. The fibers produced are used in a various application ranging from scaffolds for clinical use, to nanofiber mats for sub-micron particulate filtration. Attempts are made to fabricate more complex fibers, such as fibers, with a core material different to that of an outer shell, and fiber materials incorporating drugs in the outer shell or bacteria and viruses in the inner core. However, many of the techniques are confined to the laboratory due to the lack of advancements required for scaling up to manufacture.

FIG. 1 is a schematic diagram of a capillary type multi-jet nozzle 100 for fabricating high throughput nanofibers, according to an embodiment herein. A unique add-on type capillary type multi-jet nozzle 100 used in electrospinning, electrojetting or electrospraying devices enables forming multiple fluid jets from multiple Taylor cones. According to an embodiment herein, the capillary type multi-jet nozzle 100 comprises a plurality of pores arranged in a pore area 102 for supplying a fluid for the formation of multiple fluid jets. The pores in the pore area 102 are arranged such that the multiple fluid jets include a liquid. The individual pores comprise openings through which the fluids are discharged to form multiple cones and multiple jets. For electrohydrodynamic processes such as electrospinning, electrojetting, or electrospraying, an electric field is present in the vicinity of the device or the capillary type multi-jet nozzle 100. Electrospinning, electrojetting, and electrospraying are related processes that differ in the resultant product due to the differences in the viscosities and types of fluids used, the electric field applied, the distance of the nozzle from a collection surface, etc. According to an embodiment herein, the capillary type multi-jet nozzle 100 forms a part of an electrospinning, electrojetting, or electrospraying apparatus which further includes an electric field means arranged to form multiple fluid cones and multiple fluid jets. The electric field means includes an electric field generator and a pair of electrodes for applying an electric field between the capillary type multi-jet nozzle 100 and a collection zone which is spaced apart from the capillary type multi-jet nozzle 100.

According to an embodiment herein, the two or more pores in the pore area 102 are arranged in the capillary type multi-jet nozzle 100 to get multiple jets of fluid in the electrical field during the process of electrospinning, electrojetting, and electrospraying. This allows the fibers to be aligned over the substrate in lesser time than the single jet nozzle. The capillary type unique structure makes the nanofibers more aligned over the substrate and is user friendly and time efficient. This allows multiple jets of fibers or particles or allows a gas or a liquid sheath to be used to produce fibers or particles formed from materials supplied using highly volatile solvents. According to an embodiment herein, the two or more openings are arranged such that multiple jets formed are equal to the number of pores or openings.

According to an embodiment herein, the capillary type multi-jet nozzle 100 is arranged in two parts such as a cap system 104 and a crew/screw system 106. The upper half or the cap system 104 of the capillary type multi-jet nozzle 100 contains two or more pores in the pore area 102 and the second half or the crew/screw system 106 contains a syringe cap 114. Both the halves are tightened/fitted/connected using a screw groove system. This enables user friendly cleaning of the pores. The cleaning is easier because of the cap and crew system which further minimizes the chances of stalling or slowing down the flow rate while performing electrospinning or electrospraying or electrojetting processes. The crew system 106 without capillary pores is capped tightly to the syringe with a normal mechanical force.

According to an embodiment herein, the capillary type multi-jet nozzle 100 is made up of a good conducting material such as copper or stainless steel, so that a high-power voltage is applied in the electrospinning process. For an easy fitting operation, the nozzle outer surface is knurled by machining. According to an embodiment herein, the outer wall of the capillary type multi-jet nozzle 100 comprises a knurling groove 108 so that a crocodile clip groove is capable of being easily fixed while connecting the capillary type multi-jet nozzle 100 with a high voltage for the process of electrospinning. According to an embodiment herein, the inner wall of the capillary type multi-jet nozzle 100 is configured with a smooth surface to allow an efficient flow of a fluid to be pumped from the syringe. The inner wall is provided with capillary pores formed by wire EDM (Electric Discharge Machine). According to an embodiment herein, capillary pores arc configured in the inner wall of the capillary type multi-jet nozzle 100 by a wire Electric Discharge Machine (EDM). According to an embodiment herein, the pores or openings in the pores/pores have an inner diameter of 0.25 mm for the jet formation with better efficiencies without hindering the other jets. According to an embodiment herein, the channel which meets the syringe has smooth inner walls which is easily push fit with the tip of the syringe and the other end has an external thread of screw grooves. The multiple pores containing a channel has the internal screw threads at one end and pores on the other end. According to an embodiment herein, the capillary type multi-jet nozzle 100 is fabricated using micro-machining. A chamfer 110 is cut at an angle of 45 degrees for connecting the pores area 102 and the knurling groove 108. According to an embodiment herein, a TEFLON® gasket 112 is used for proper tightening and sealing of the cap system 104 and the crew system 106. The crew system 106 will be capped tightly to the syringe, with a normal mechanical force using a connecting portion to the syringe.

Figure 2:
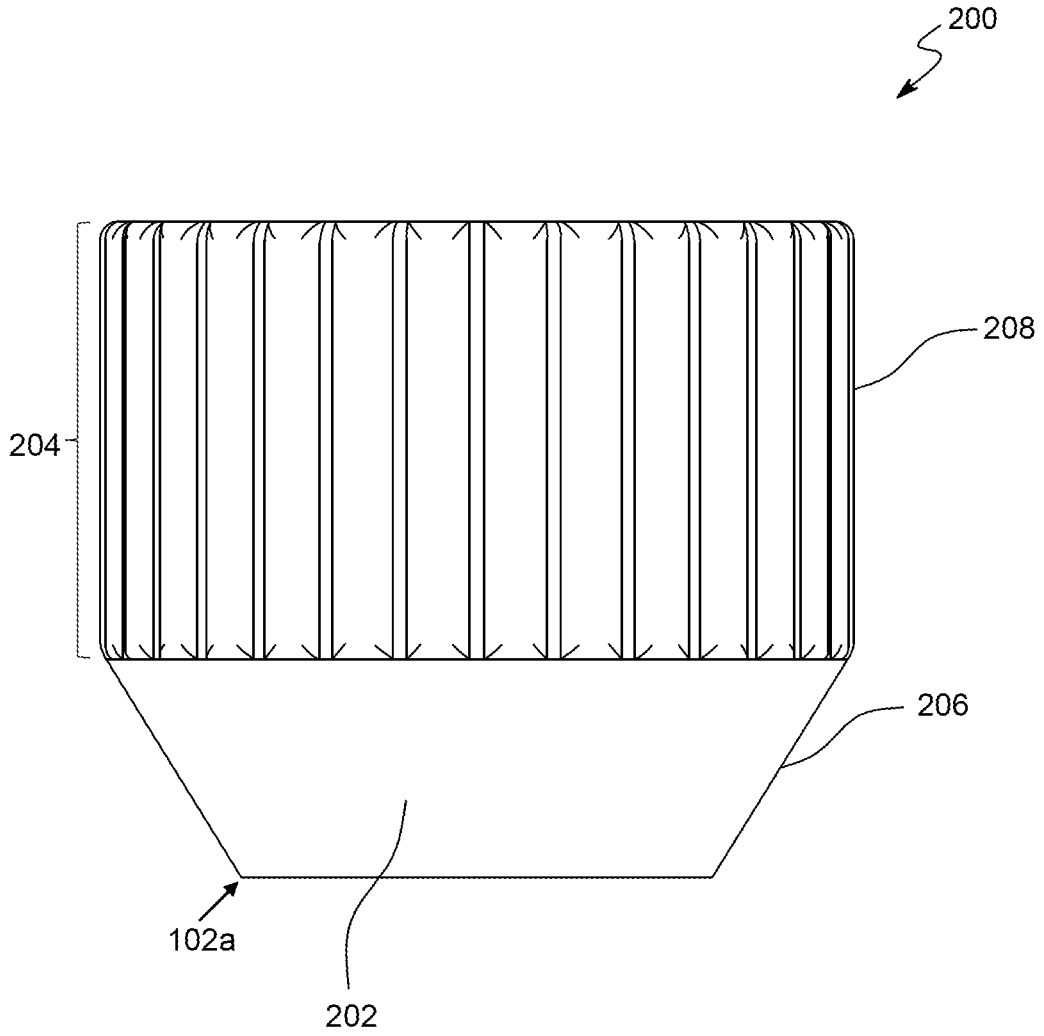
FIG. 2 illustrates a side view of a cap system in the capillary type multi-jet nozzle, according to an embodiment herein.

FIG. 2 shows a side view of a cap system 200 of the capillary type multi-jet nozzle, according to an embodiment herein. According to an embodiment herein, the capillary type multi-jet nozzle has two parts known as a cap system 200 and a crew system. The cap system 200 is held by a crocodile clip during an electrospinning process. The side view of the cap system 200 for the capillary type multi-jet nozzle with eight pores in the capillary pore area 202 is shown with an outer diameter of 11 mm and an inner diameter of 7.5 mm. The length of the knurling 208 is 7 mm. The knurling 208 is provided over the straight portion 204 after the chamfer 206. The outer diameter of the chamfer 206 is 7 mm 214 and a half length of the conical part is 3.5 mm. The distance of an edge part 102*a* from a capillary action part 102*b* shown in FIG. 1, is 0.4 mm 218. Capillary action diameter is 6.2 mm (not shown). The diameter of the capillary action part 102*b* is 6.2 mm. The knurling 208 is configured to provide a proper grip between the capillary type multi-jet nozzle and the crocodile clip to get connected (to apply) a high voltage.

Figure 3:
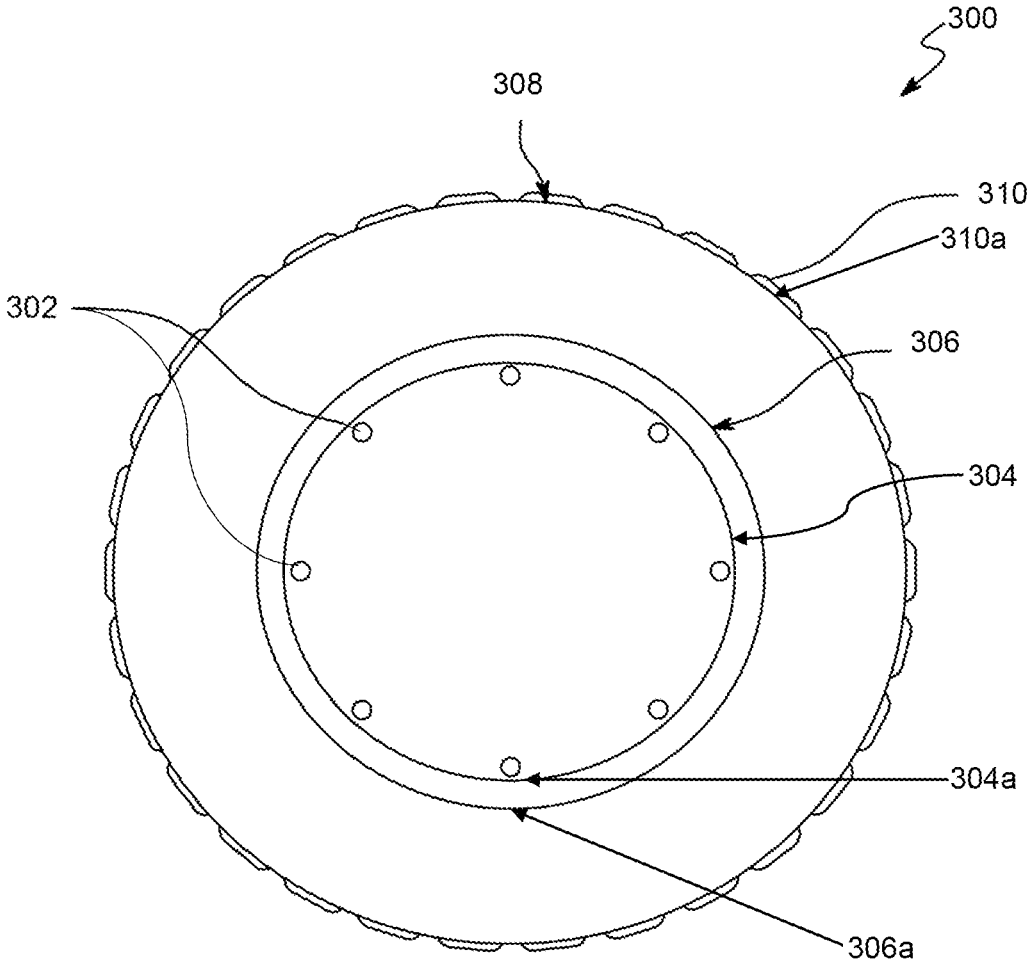
FIG. 3 illustrates a front view of a cap system in the capillary type multi-jet nozzle, according to an embodiment herein.

FIG. 3 shows a front view of a cap system 300 of the capillary type multi-jet nozzle, according to an embodiment herein. The cap system 300 of the capillary type multi-jet nozzle includes capillary pores 302 and the number of pores are varied based on the requirements. According to an embodiment herein, there are up to forty or more capillary pores 302 in the cap system 300. The number of capillary pores 302 in the capillary type multi-jet nozzle is customized based on a requirement. The capillary pores 302 support the electrospinning, electro-jetting or electro-spraying process with a capillary action. The cap system 300 of the capillary type multi-jet nozzle is shown with eight capillary pores 302 in FIG. 3. Each individual capillary pore 302 is of 0.25 mm in diameter. The diameter of the inner circle 304 is 7.5 mm. The angle between two adjacent pores from the centre is 45°. The distance of the edge part 306*a* from the capillary action part 304*a* is 0.4 mm. The radius of each knurling turn 310 of the outer circle 308 is 5.5 mm, and the knurling distance is 1 mm AA when considered in a straight pattern. The distance between the starting point 310*a* of the knurling pattern 310 and the intermediate circle 306 is 3.5 mm. The radius of the intermediate circle 306 is 3.50 mm and the distance between the intermediate circle 306 to the starting point 310*a* of the knurling pattern 310 is 2 mm. The size of one knurling pattern 310 is 1 mm on the circular or outer surface.

Figure 4:
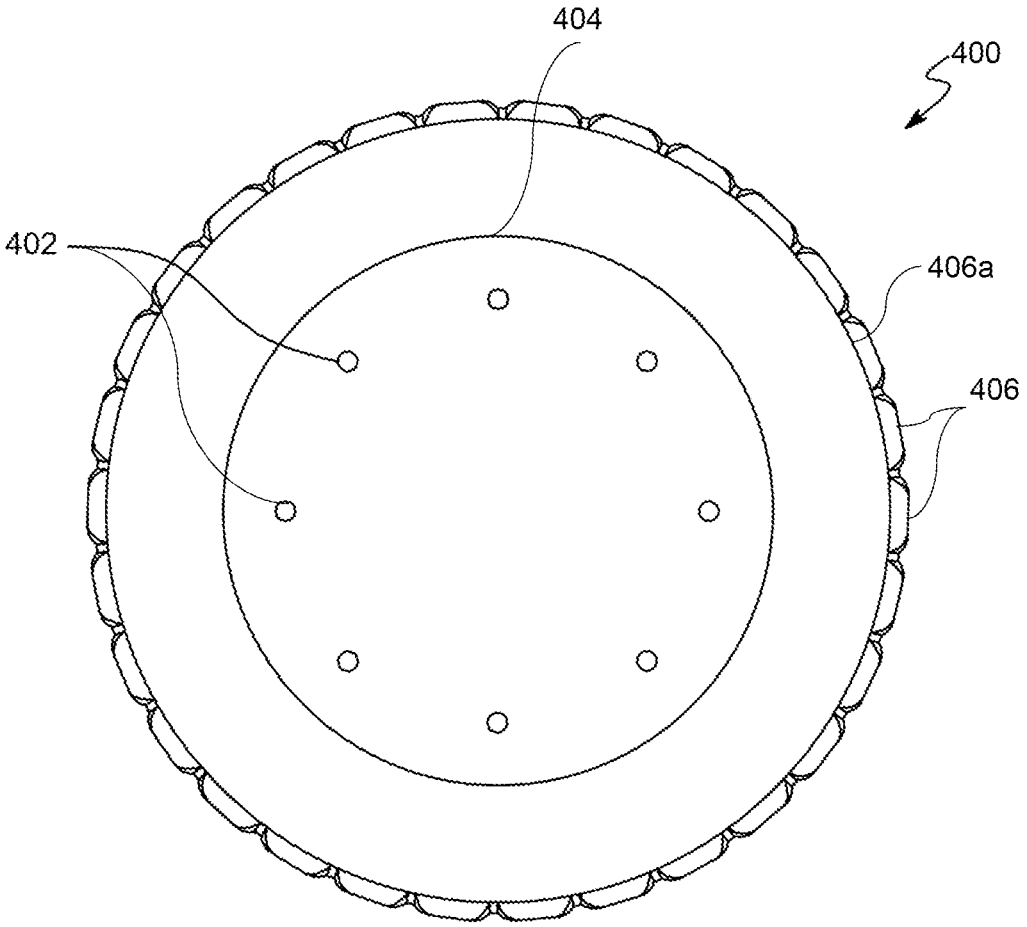
FIG. 4 illustrates an inner view of a cap system in the capillary type multi-jet nozzle, according to an embodiment herein.

FIG. 4 shows an inner view of a cap system 400 in the capillary type multi-jet nozzle, according to an embodiment herein. The inner view of the cap system 400 in the capillary type multi-jet nozzle is shown with eight capillary pores 402. The diameter of the inner circle 404 of the cap system 400 is 7.5 mm, and the distance from the centre to the starting point 406*a* of the knurling pattern 406 is 5.5 mm. The distance between the inner circle 404 and the starting point 406*a* of the knurling pattern 406 is 3.75 mm. The angle between the mid-points of adjacent knurling 406 from the centre is 12°. The diameter of each capillary pore 402 is 0.25 mm which is the same as described in FIG. 1, and the distance of the capillary pore 402 from the centre is 2.9 mm. The angle of the capillary pore to an adjacent pore from the centre is 45°, and the distance of the edge part from the capillary action part is 0.4 mm.

Figure 5:
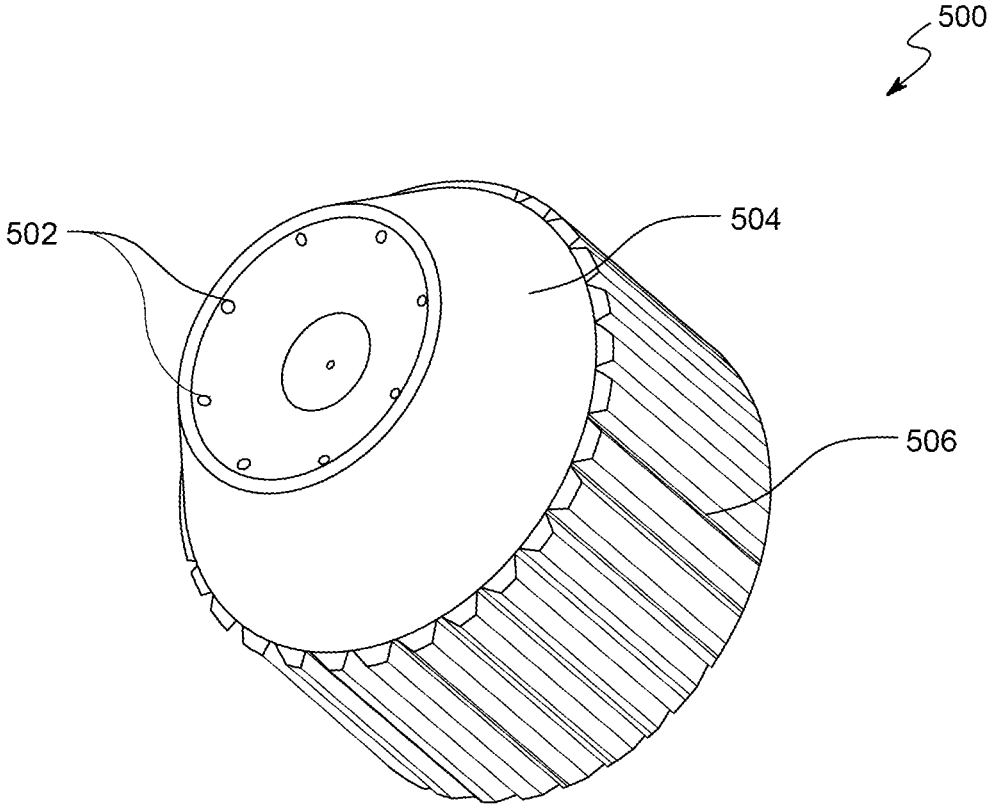
FIG. 5 illustrates an isometric view of a cap system in the capillary type multi-jet nozzle, according to an embodiment herein.

FIG. 5 shows an isometric view of a cap system 500 in the capillary type multi-jet nozzle, according to an embodiment herein. The capillary type multi-jet nozzle comprises two parts, known as the cap system 500 and the crew system, herein referred to as a crew-cap system. The crew system holds a syringe. The system/portion/coupling that meets the syringe has smooth inner walls which is easily push fit with the tip of the syringe, while the other end of the screw/crew grooves system comprises screws with external threads. The isometric view of the cap system 500 including capillary pores 502, the chamfer 504, and the knurling 506 is shown in FIG. 5.

Figure 6:
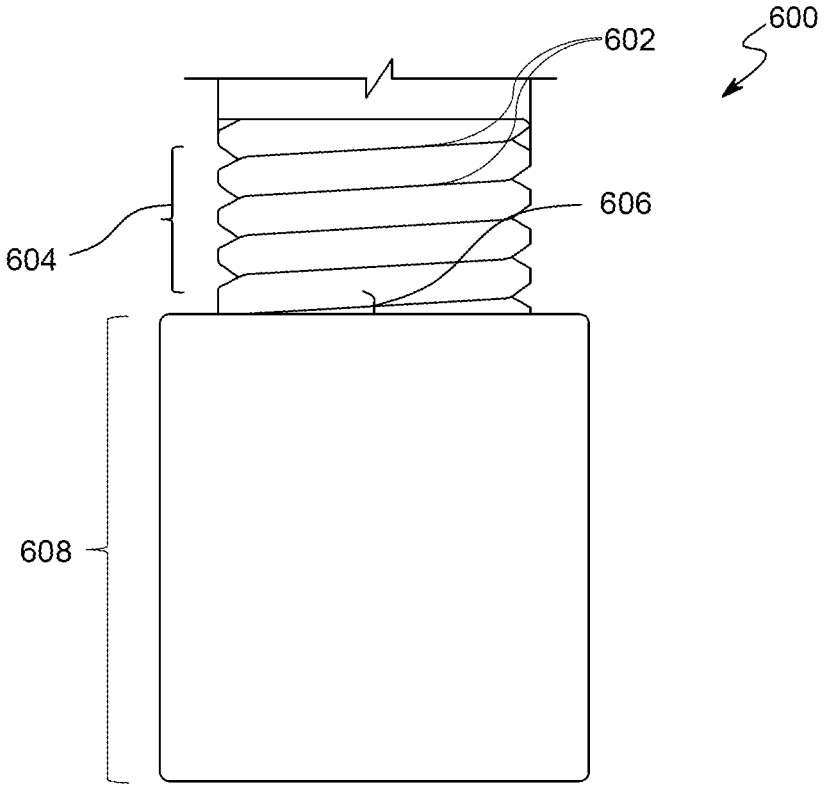
FIG. 6 illustrates a side view of a crew system in the capillary type multi-jet nozzle, according to an embodiment herein.

FIG. 6 shows a side view of a crew system 600 in the capillary type multi-jet nozzle, according to an embodiment herein. The crew system 600 is the secondary part of the capillary type multi-jet nozzle which supports a syringe for the electrospinning, electrojetting and electrospraying processes with a capillary action. The outer diameter and the inner diameter of the grooves in the threads 602 of the screw groove system 604 shown in the front view of the crew system 600 for the capillary type multi-jet nozzle are 8 mm and 4 mm respectively. A pitch 606 of threads of the screw groove system 604 is 1 mm. The length of the crew system 600 is 17 mm, the screw thread length of the screw groove system 604 is 5 mm, and the portion 608 below the screw thread groove system 604 is 12 mm. The total diameter of the crew system 600 is 11 mm and the inner diameter of the crew system 600 is 4 mm. The syringe is configured to fit at an opening with a diameter of 4 mm diameter in the crew system 600.

Figure 7:
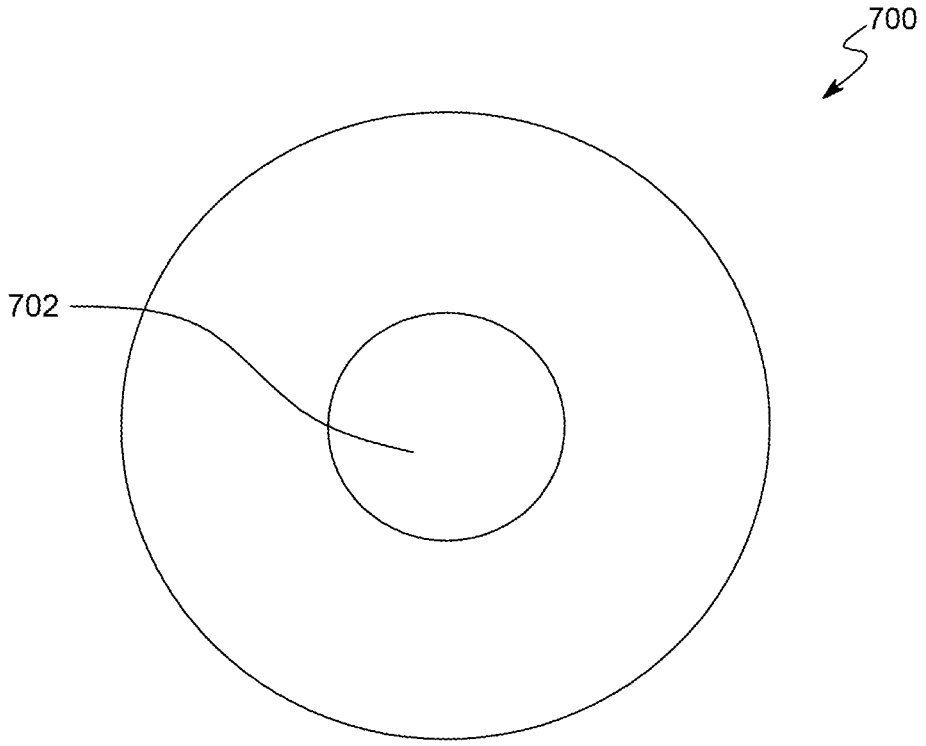
FIG. 7 illustrates a bottom view of a crew system in the capillary type multi-jet nozzle, according to an embodiment herein.

FIG. 7 shows a bottom view of a crew system 700 in the capillary type multi-jet nozzle, according to an embodiment herein. The bottom view of the crew system 700 for the capillary type multi-jet nozzle which holds the syringe is shown in FIG. 7. The outer diameter of the crew system 700 is 11 mm and the inner diameter of the crew system 700 is 4 mm. The outer diameter and the inner diameter of the screw groove system (not shown in FIG. 7) of the crew system 700 is 8 mm and 4 mm respectively. The crew system 700 comprises a syringe attaching hole 702 at the bottom as shown in FIG. 7.

Figure 8A:
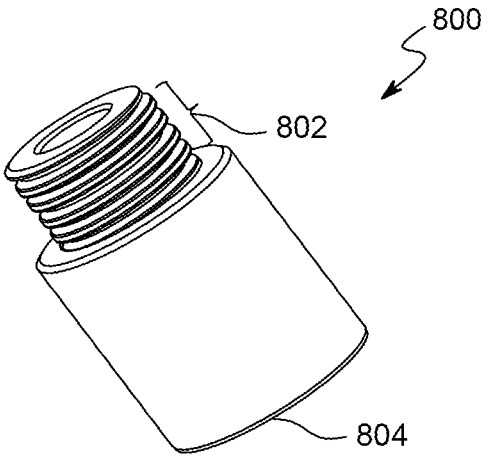
FIG. 8A illustrates an isometric view of a crew system in the capillary type multi-jet nozzle, according to an embodiment herein.
Figure 8C:
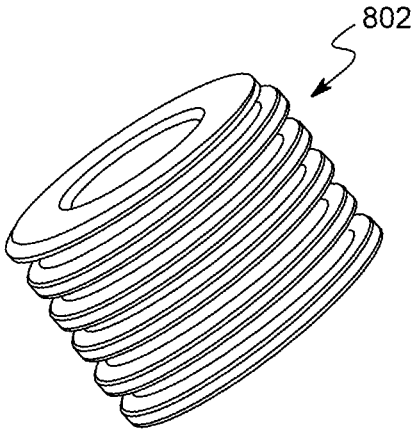
FIG. 8C illustrates a perspective view of a screw groove system in the capillary type multi-jet nozzle, according to an embodiment herein.
Figure 8B:
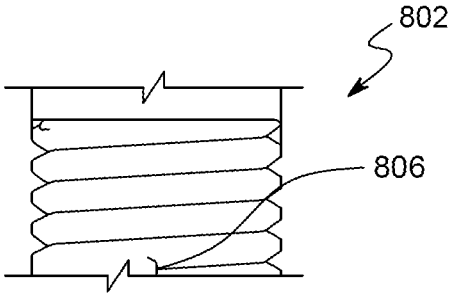
FIG. 8B illustrates a side sectional view of a screw groove system in the capillary type multi-jet nozzle, according to an embodiment herein.

FIG. 8A shows an isometric view of a crew system 800 in the capillary type multi-jet nozzle, according to an embodiment herein. FIG. 8A shows a screw thread with a groove system 802 and a syringe attaching hole 804. FIG. 8B shows a side view of the screw threads with grooves 802 in the capillary type multi-jet nozzle. The outer diameter and the inner diameter of the grooves in the screw thread 802 of the screw system 800 is 8 mm and 4 mm respectively. A pitch 806 of the screw thread 802 is 1 mm. FIG. 8C shows an isometric view of the screw thread/groove system 802 in the capillary type multi-jet nozzle.

Figure 9A:
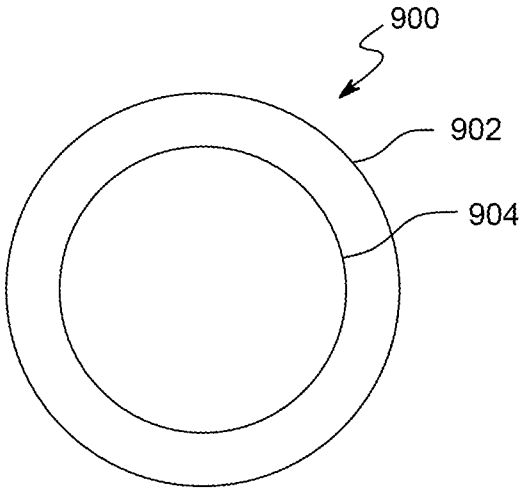
FIG. 9A illustrates a top view of a TEFLON® gasket used in the capillary type multi-jet nozzle, according to an embodiment herein.
Figure 9C:
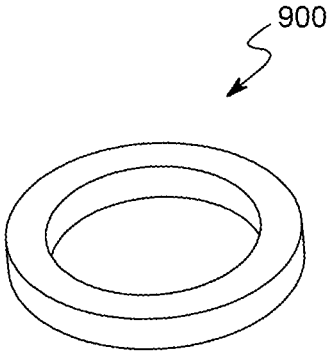
FIG. 9C illustrates an isometric view of a TEFLON® gasket used in the capillary type multi-jet nozzle, according to an embodiment herein.
Figure 9B:
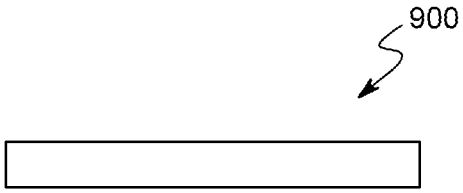
FIG. 9B illustrates a side view of a TEFLON® gasket used in the capillary type multi-jet nozzle, according to an embodiment herein.

FIGS. 9A-9C illustrate a top view, a side view, and an isometric view of a TEFLON® gasket 900 in the capillary type multi-jet nozzle, according to an embodiment herein. The TEFLON® gasket 900 is used for proper tightening and sealing of the cap system and the screw system. FIG. 9A shows the top view of the TEFLON® gasket 900 with an outer radius of 5 ram and an inner radius of 4 mm. The thickness of the TEFLON® gasket 900 is 1.5 mm as shown in FIG. 9B. The inner diameter of the TEFLON® gasket is 8 mm and the outer diameter of the TEFLON® gasket 900 is 11 mm respectively. The isometric view of the TEFLON® gasket 900 is shown in FIG. 9C.

Figure 10:
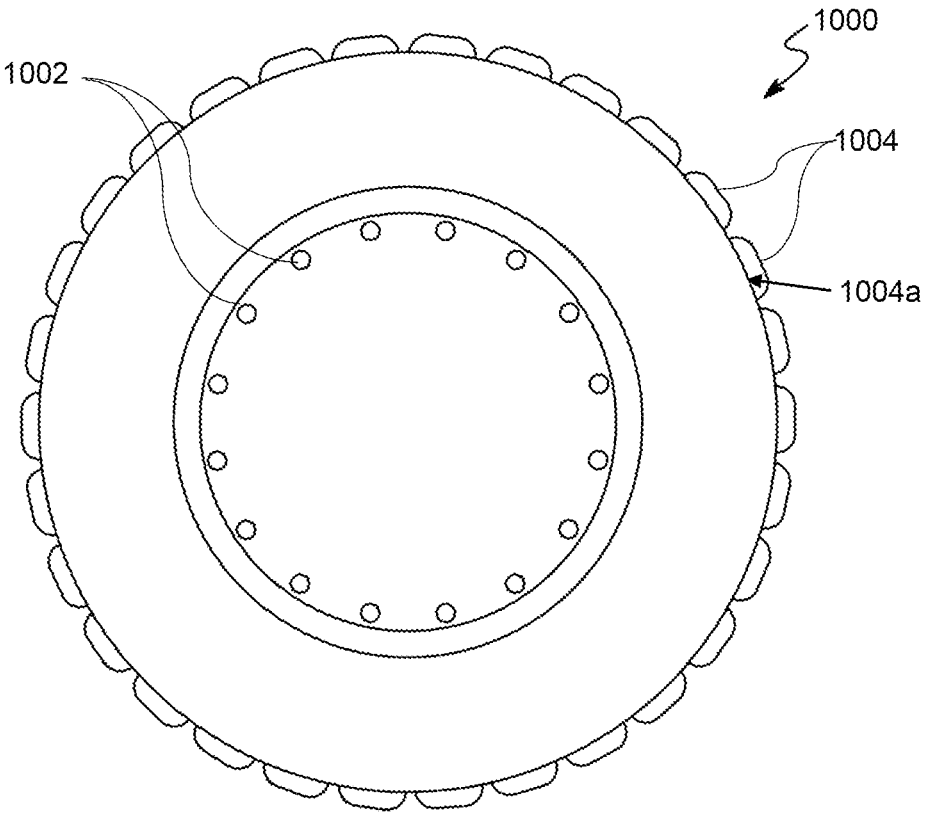
FIG. 10 illustrates a top view of a cap system in the capillary type multi-jet nozzle with sixteen pores, according to an embodiment herein.

FIG. 10 shows a top view of a cap system 1000 in the capillary type multi-jet nozzle with sixteen pores 1002, according to an embodiment herein. The top view of the cap system 1000 of the capillary based multi-nozzle is shown with 16 pores 1002 and the angle between the adjacent pores 1002 from the centre of the cap system 1000 is 22.5°, while the rest of the dimensions of the cap system 1000 are as explained/mentioned above. The circular diameter of the cap system 1000 is 7.5 mm, and the distance between the centre of the cap system 1000 to the starting point 1004*a* of the knurling pattern 1004 is 5.5 mm. The angle between the mid-points of adjacent knurling 1004 from the centre of the cap system 1000 is 12°. The diameter of each capillary pore 1002 is 0.25 mm which is same as mentioned in FIG. 1, and the distance of the capillary pore 1002 from the centre of the cap system 1000 is 2.9 mm.

Figure 11:
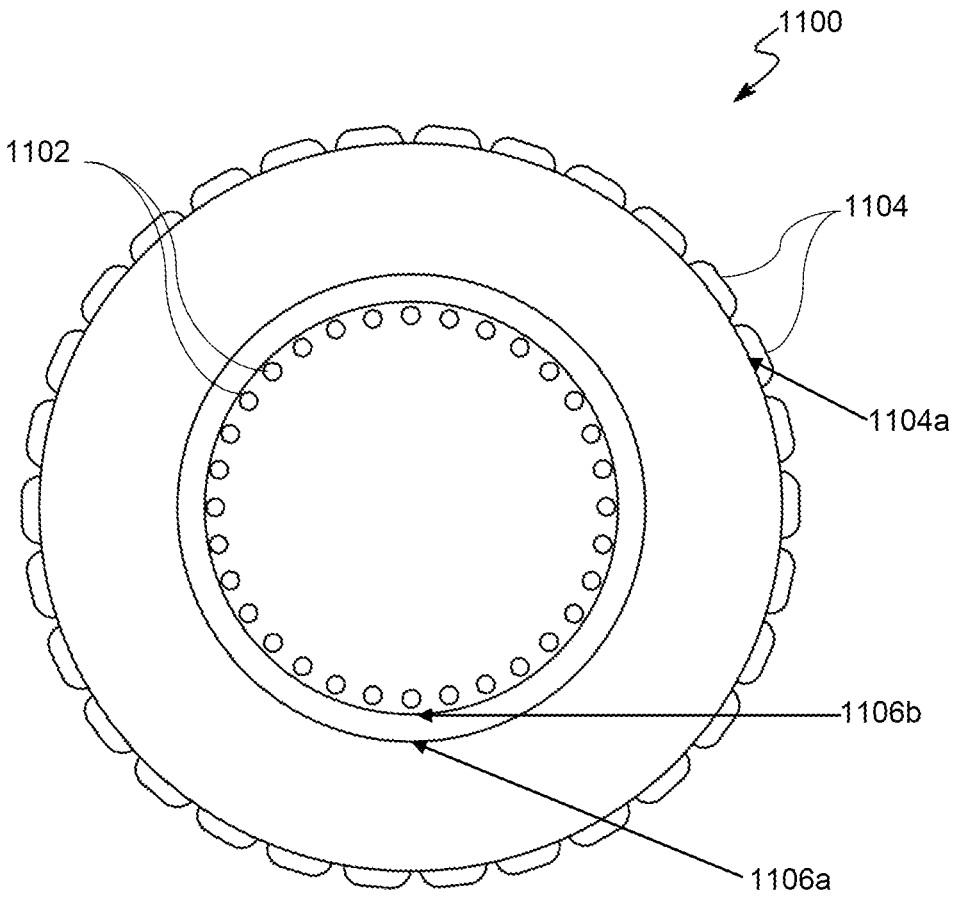
FIG. 11 illustrates a top view of a cap system in the capillary type multi-jet nozzle with thirty two pores, according to an embodiment herein.

FIG. 11 shows a top view of a cap system 1100 in the capillary type multi-jet nozzle with thirty two pores 1102, according to an embodiment herein. The cap system 1100 of the capillary based multi-nozzle with 32 pores 1102 is shown with an angle of 11.25° between adjacent pores 1102 from the centre of the cap system 1100. The circular diameter of the cap system 1100 is 7.5 mm, and the distance from the centre of the cap system 1100 to the starting point 1104*a* of the knurling pattern 1104 is 5.5 mm. The angle between the mid-points of adjacent knurling 1104 from the centre of the cap system 1100 is 12°. The diameter of each capillary pore 1102 is 0.25 mm which is the same as mentioned in FIG. 1, and the distance of each capillary pore 1102 from the centre of the cap system 1100 is 2.9 mm. The distance of an edge part 1106*a* from a capillary action part 1106*b* is 0.4 mm.

Figure 12:
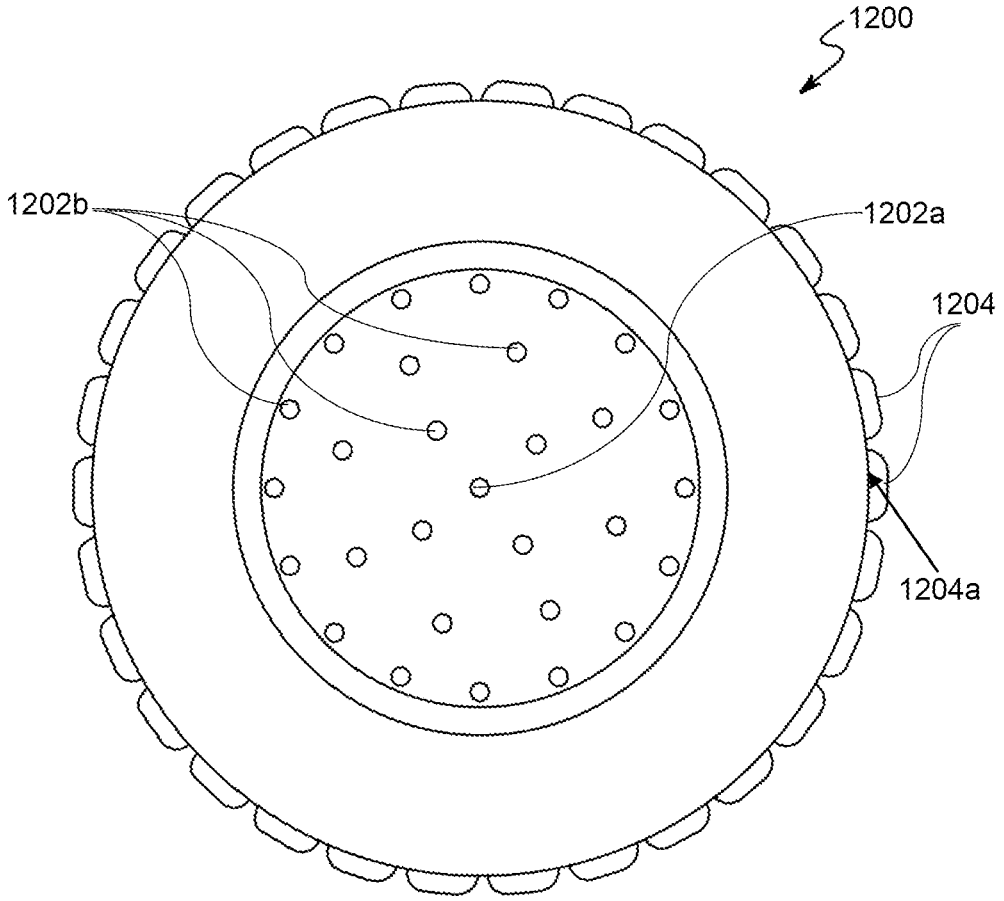
FIG. 12 illustrates a top view of a cap system in the capillary type multi-jet nozzle with thirty nine pores, according to an embodiment herein.

FIG. 12 shows a top view of a cap system 1200 in the capillary type multi-jet nozzle with thirty nine pores 1202*a* and 1202*b*, according to an embodiment herein. The cap system 1200 of the capillary based multi-nozzle with 39 pores 1202*a* and 1202*b* used in electrospinning, electro jetting, and electro spraying devices is shown in FIG. 12. From the central pore 1202*a*, all other pores 1202*b* are designed to be arranged on three consecutive concentric circles that are equidistant from each other. The pores 1202*a* and 1202*b* are of similar or same dimensions as mentioned above and all the other dimensions of the capillary type multi-jet nozzle remain the same as explained in the previous figures. The angle between the adjacent pores on the first circle from the central pore 1202*a* is 90°. Similarly, the angle between the adjacent pores on the second adjacent circle from the central pore 1202*a* is 45°, and the angle between the adjacent pores on the third concentric circle from the central pore 1202*a* is 22.5°. The circular diameter of the cap system 1200 is 7.5 mm, and the distance between the centre of the cap system 1200 to the starting point 1204*a* of the knurling pattern 1204 is 5.5 mm.

There are no such comparable innovations existing for a cap and a crew type capillary action based multi-jet nozzle for electrospinning, electrojetting, and electrospraying. The overall advantages are enlisted below. The embodiments herein also provide a multi-jet electrospinning, electrojetting, or electrospray apparatus arranged to form multiple jets pumped from the syringe. Syringe herein means the syringe to be used during electrospinning, electrojetting, or electrospraying processes. According to an embodiment herein, the capillary action based multi-jet nozzle enables to maintain a high-throughput nanofiber, nano-droplet and nano-particle fabrication using electrospinning, electrojetting, and electrospraying processes respectively. The number of pores is customized to be within 2 to 39 or more based on the need. The customized pores provide flexibility and ease of use.

The capillary action based multi-jet nozzle also provides small angles to grooves to form multiple non-interfering and non-hindering jets and reduces operating time in electrospinning, electrospraying, and electrojetting processes. The capillary action based multi-jet nozzle achieves the uniform nanofiber coating with almost monodispersed pores between the nanofibers. The capillary action based multi-jet nozzle is an easy to clean system with the cap and crew system thereby allowing easy electrospraying of the high viscous fluids. The cleaning is easier because of the cap and crew model system thereby minimizing the chances of stalling or slowing down the flow rate during electrospinning, electrospraying, and electrojetting processes. The capillary action based multi-jet nozzle enables a faster electrospinning process with respect to time and a high throughput process thereby eliminating a loss of the fluid as wastage. The capillary action based multi-jet nozzle includes a method of manufacturing fibers, particles, or droplets.

Any person skilled in the art will readily appreciate that various modifications and alterations may be made to the above described capillary type multi-jet nozzle and electrospinning components and system without departing from the scope of the appended claims. For example, different materials, dimensions and number of pores in the nozzle may be used in different embodiments. In addition, although the above described embodiments largely relate to electrospinning, these techniques and devices may also be also used for electrospraying and electrojetting.

In the above description, numerous specific details are set forth to provide a thorough understanding of the embodiments. One skilled in the relevant art will recognize, however that the embodiments can be practiced without one or more of the specific details or with other methods, components, techniques, etc. In other instances, well-known operations or structures are not shown or described in detail.

Although the processes illustrated and described herein include a series of steps, it will be appreciated that the different embodiments are not limited by the illustrated ordering of steps, as some steps occur in different orders, some concurrently with other steps apart from that shown and described herein. In addition, not all illustrated steps may be required to implement a methodology in accordance with the one or more embodiments. Moreover, it will be appreciated that the processes may be implemented in association with the apparatus and systems illustrated and described herein as well as in association with other systems not illustrated.

The above descriptions and illustrations of embodiments, including what is explained in the abstract, is not intended to be exhaustive or to limit the one or more embodiments to the precise forms disclosed. While specific embodiments of, and examples for, the one or more embodiments are described herein for illustrative purposes, various equivalent modifications are possible within the scope, as those skilled in the relevant art will recognize. These modifications can be made in light of the above detailed description. Rather, the scope is to be determined by the following claims, which are to be interpreted in accordance with established doctrines of claim construction.

What is claimed is:

1. A capillary type multi-jet nozzle for fabricating high throughput nanofibers by an electrospinning technique, the capillary type multi-jet nozzle having a cap system with one or more pores; a screw system with the cap system on one side of the screw system, and a syringe cap on an opposite side of the screw system, wherein polymer fluid is pumped through a syringe from an end of the syringe cap; a pore area having the one or more pores; a knurling groove, wherein a chamfer connects the pore area having the one or more pores with the knurling groove, wherein a gasket is used for tightening and sealing of the cap system and the screw system such that upon receipt of the polymer liquid from the syringe, jets are produced from the one or more pores.

2. The capillary type multi-jet nozzle of claim 1, wherein the capillary type multi-jet nozzle is made of a conducting material.

3. The capillary type multi-jet nozzle of claim 1, wherein an inner wall of the capillary type multi-jet nozzle has a smooth surface.

4. The capillary type multi-jet nozzle of claim 1, wherein the capillary type multi-jet nozzle is fabricated using micromachining.

* * * * *